United States Patent [19]

Roth

[11] Patent Number: 4,955,854

[45] Date of Patent: Sep. 11, 1990

[54] APPARATUS FOR SUBDIVIDING STACKS OF SHEETS OF PAPER AND THE LIKE

[76] Inventor: Oscar Roth, Reblandstrasse 17, CH-5622 Waltenschwil Schweiz, Switzerland

[21] Appl. No.: 387,163

[22] Filed: Jul. 28, 1989

[30] Foreign Application Priority Data

Aug. 1, 1988 [CH] Switzerland ..... 2905/88
Dec. 13, 1988 [CH] Switzerland ..... 4603/88

[51] Int. Cl.[5] ..... B65H 35/10; B65H 33/02

[52] U.S. Cl. ..... 225/103; 83/91; 493/357

[58] Field of Search ..... 493/357, 412, 413, 414, 493/415, 416; 83/91; 225/103

[56] References Cited

U.S. PATENT DOCUMENTS

| | | | |
|---|---|---|---|
| 4,673,382 | 6/1987 | Buck et al. | 493/359 |
| 4,721,295 | 1/1988 | Hathaway | 270/52.5 |
| 4,842,572 | 6/1989 | Roth | 493/357 |
| 4,854,932 | 8/1989 | Schlottke et al. | 493/357 |

*Primary Examiner*—William E. Terrell
*Attorney, Agent, or Firm*—Peter K. Kontler

[57] ABSTRACT

Apparatus for subdividing a stack into a number of piles of overlapping sheets has an elevator which can move a stack upwardly in stepwise fashion between a belt conveyor and a horizontally reciprocable carriage for a pusher and a blade-like horizontal separating element which extends beyond the pusher in a direction toward the conveyor. When a selected part of the stack extends above the level of the upper reach of the conveyor, the carriage is moved toward the conveyor so that the separating element penetrates between two sheets of the stack and the pusher thereupon transfers the pile above the separating element onto the conveyor. Two hold-down devices enter the gap which is formed in the stack as a result of penetration of the separating element to prevent the topmost sheet of the remaining portion of the stack from participating in the movement of the separating element toward the conveyor. The thickness of the rounded tip of the separating element is less than 0.9 millimeter.

35 Claims, 5 Drawing Sheets

APPARATUS FOR SUBDIVIDING STACKS OF SHEETS OF PAPER AND THE LIKE

CROSS-REFERENCE TO RELATED CASE

An apparatus for breaking up a web which folded in zig-zag formation into stacks is disclosed in commonly owned U.S. Pat. No. 4,842,572 granted June 27, 1989.

BACKGROUND OF THE INVENTION

The invention relates to apparatus for manipulating accumulations of overlapping sheets of paper or the like. More particularly, the invention relates to apparatus for manipulating stacks of sheets.

It is well known to gather stacks of overlapping sheets in automatic stacking machines. As a rule, or in many instances, stacks are gathered on pallets which render it possible to conveniently transport full stacks with fork lifts or in any other suitable way. However, subdivision of full stacks into smaller stacks or piles is normally, or frequently, still carried out by hand. Subdivision of full stacks into smaller stacks or piles is often necessary preparatory to introduction of smaller stacks or piles is often necessary preparatory to introduction of smaller stacks into a processing machine, e.g., into a wrapping machine for reams or other accumulations of panels or sheets. The piles should be of equal height, and such piles are frequently put into temporary storage prior to admission into a processing machine. Since an automatic processing machine is capable of treating a large number of piles per unit of time, manual subdivision of stacks into piles involves strenuous work which is often carried out by several attendants.

OBJECTS OF THE INVENTION

An object of the invention is to provide a novel and improved apparatus for subdividing stacks of overlapping paper sheets or the like into smaller stacks or piles at the rate at which the piles can be processed in an automatic machine, e.g., in a wrapping machine.

Another object of the invention is to provide an apparatus which can break up stacks into smaller stacks or piles and the operation of which can be automated to any desired extent.

A further object of the invention is to provide an apparatus which is constructed and assembled in such a way that its parts are not likely to damage the sheets of a stack during subdivision of the stack into smaller stacks or piles.

An additional object of the invention is to provide the apparatus with novel and improved means for initiating the subdivision of a stack into piles by partially segregating a selected number of sheets or panels at the top of the stack.

Still another object of the invention is to provide the apparatus with novel and improved means for measuring the height of a full or partly depleted stack.

A further object of the invention is to provide a novel and improved method of subdividing or breaking up large stacks of overlapping sheets of paper or the like into smaller stacks or piles.

An additional object of the invention is to provide a method which renders it possible to subdivide stacks at a high frequency, without damage to the sheets or panels of the stack, and in such a way that the height of each pile matches or closely approximates a desired value.

Another object of the invention is to provide an apparatus which can be used in a production line between one or more sheet stacking machines and one or more processing machines for relatively small accumulations of overlapping sheets.

SUMMARY OF THE INVENTION

The invention is embodied in an apparatus for subdividing stacks of overlapping sheets of paper into piles or smaller stacks. The improved apparatus comprises a stack-supporting elevator which is movable up and down to move a stack thereon along a substantially vertical path, and a conveyor which is adjacent one side of the vertical path and has a substantially horizontal surface disposed at a predetermined level and serving to receive piles from the stack on the elevator whereby the height of the stack decreases as a result of removal of a pile from its top and the elevator must move upwardly in order to raise a fresh incipient pile above the predetermined level. The apparatus further comprises means for transferring piles from the top of the stack on the elevator onto the surface of the conveyor, and such transferring means includes a pusher which is disposed above the predetermined level, a substantially horizontal and substantially flat metallic or plastic separating element which is disposed beneath the pusher at or above the predetermined level and extends beyond the pusher toward the conveyor, and means for reciprocating the pusher and the separating element along a substantially horizontal path between a retracted position in which the pusher and the separating element are located at a first distance from the conveyor at the other side of the vertical path, and a second position in which the pusher and the separating element are located at a shorter second distance from the conveyor. Thus, the separating element penetrates into the stack on the elevator beneath that pile of sheets which is located above the separating element, and the pusher thereon transfers the thus formed pile from the vertical path onto the surface of the conveyor, during movement of the pusher and the separating element from the first position to the second position. The pusher and the separating element are thereupon moved back to the first position and the elevator is caused to move upwardly so as to lift a pile of sheets above the level of the separating element before the pusher and the separating element are caused to again move from the first to the second position.

The elevator can comprise a platform and a pallet for a stack on the platform. Such design of the elevator is preferred at this time because a tall and heavy stack of sheets can be placed onto a pallet at a location remote from the platform and the pallet is thereupon pushed, pulled or otherwise moved onto the platform before the latter is lifted to move a selected pile above the level of the separating element (which is then maintained in the first or retracted position).

The substantially horizontal surface of the conveyor is, or can be, closely adjacent the one side of the vertical path.

In accordance with a preferred embodiment of the invention, the separating element includes a tip which is nearest the conveyor (i.e., which is first to penetrate into a stack on the elevator in response to movement of the pusher and separating element from the first toward the second position) and has a thickness which is a fraction of one millimeter, preferably less than 0.9 mm and most preferably approximately 0.5 millimeter. The thickness of the tip of the separating element is or can be substantially constant. The tip can have a rounded edge which confronts the conveyor, and the width of the tip and/or the adjacent front portion of the separating element can increase in the substantially horizontal plane of the separating element in a direction away from the conveyor. The separating element (or at least that portion of the separating element which penetrates into a stack on the elevator during movement of the pusher and separating element toward the second position) can consist of or include two mirror symmetrical halves.

That (front) portion of the separating element which is immediately adjacent or includes the tip can have a width of less than 61 millimeters. As stated above, the tip can have a rounded outline in the substantially horizontal plane of the separating element. The front portion of the separating element can have a substantially wedge-shaped outline in the horizontal plane of the separating element, and such front portion tapers toward the tip. The thickness of a portion of or even the entire separating element can increase gradually starting at or including the tip and proceeding in a direction away from the conveyor.

A second portion of the separating element behind the front portion is or can be much wider than the front portion, and such second portion can have rounded front edge faces which confront the conveyor and slope toward the tip at opposite sides of and behind the front portion of the separating element. The radii of curvature of the rounded front edge faces of the second portion of the separating element are preferably small, e.g., less than 0.6millimeter and most preferably between approximately 0.2 and 0.35 millimeter. This ensures ready penetration of the second portion into a stack without damaging the adjacent sheet or sheets.

At least a portion of the external surface of the separating element is preferably polished to a high degree of finish. This term is intended to embrace standard polishing as well as lapping and like treatments which are known to impart to a surface (particularly a metallic surface) a high degree of smoothness.

The separating element can be provided with one or more suitably distributed and/or configurated channels, and the external surface of the separating element can be provided with one or more ports for each channel to discharge streamlets of a pressurized fluid (e.g., compressed air), at least while the separating element is in the process of penetrating into a stack on the elevator, so as to promote separation of the thus obtained incipent pile from the top of the remainder of the stack or from the elevator, depending upon whether the separating element has penetrated between two neighboring sheets of the stack or beneath the lowermost sheet of the remnant of a stack on the pallet of the elevator. A source of pressurized fluid can be connected to the channel or channels of the separating element by one or more flexible hoses, by telescoped tubes or in any other suitable manner if it is desired to mount the source of pressurized fluid in such a way that it need not share the reciprocatory movements of the separating element. All that counts is to ensure that the separating element can admit one or more jets of streamlets of pressurized fluid into the gap which develops as a result of penetration of the separating element into a stack or beneath a stack on the elevator.

The conveyor can include an endless belt comprising an upper reach with a friction generating upper side which constitutes or includes the horizontal surface. This ensures that the lowermost sheet of a pile which is transferred from the vertical path will begin to share the movement of the upper reach of the conveyor as soon as it reaches the friction generating upper side of the upper reach.

The pusher and/or the separating element can be mounted for movement up and down with reference to the reciprocating means, and such transferring means preferably further comprises means for biasing the pusher and the separating element downwardly. Such mounting of the separating element reduces the likelihood that the tip of the separating element and/or the front edge faces of the front and/or second portion of the separating element would damage the adjacent sheet or sheets of the stack on the elevator during penetration of the separating element into the stack and particularly beneath the stack because the tip of the separating element can yield by moving upwardly. The elevator includes a portion (e.g., a portion of the aforementioned pallet) which extends beyond the stack on the elevator in a direction away from the conveyor, and the tip of the separating element can be moved into the path of upward movement of the elevator portion so that such elevator portion can lift the separating element against the opposition of the biasing means. The transferring means and/or another part of the apparatus (e.g., the frame) can include means for limiting the upward movement of the separating element to not more than one millimeter or a few millimeters preparatory to movement of the separating element and the pusher to the second position in order to transfer the last pile of a stack.

The apparatus preferably further comprises hold-down devices which flank the separating element, and means for moving the hold-down devices into and from the vertical path in order to introduce the hold-down devices into the gap which is established by the separating element as a result of penetration into a stack on the elevator. The hold-down devices serve to hold the stack portion below the separating element against movement toward the conveyor while the separating element and the pusher move toward their second positions. Such apparatus can further comprise means which defines for the hold-down devices substantially horizontal pivot axes extending substantially transversely of the direction of reciprocatory movement of the separating element. Each hold-down device includes a front arm which penetrates into the aforementioned gap and is tiltable downwardly about the respective pivot axis to bear against the topmost sheet of the stack beneath the gap. The arms can constitute substantially wedge-shaped portions of the hold-down devices, and such wedge-shaped portions taper toward the conveyor to ensure ready penetration into a freshly formed gap.

The apparatus preferably further comprises means for measuring the height of the stack on the elevator. Such measuring means can comprise a stop which is disposed above the vertical path when the measuring means is in use and the stop serves to arrest the ascending topmost sheet of the stack on the elevator and to thus hold the elevator against further upward movement, an upright scale which is adjacent the vertical path and is graduated to indicate the height of a stack between the topmost sheet which is arrested by the stop and the lowermost sheet, and a sensor or indicator which is movable along the scale into and from engagement with the elevator in the region of the lowermost sheet of a stack on the elevator to pinpoint the proper graduation on the scale. The measuring means can further include optical or other suitable means for generating signals which denote the distance of the stop from the sensor. The stop is preferably movable with reference to the elevator to and from an operative position in the vertical path, and the sensor is also movable to and from an operative position e.g., a position adjacent the aforementioned scale.

The conveyor can be mounted for movement with reference to the elevator in order to move its horizontal surface nearer to or further away from the vertical path.

The apparatus can be provided with means for vibrating, oscillating and/or similarly moving the separating element, at least during penetration into a stack on the elevator, preferably substantially horizontally back and forth and substantially transversely of the direction of movement of the separating element between the first and second positions. This facilitates penetration of the tip and other parts of the separating element into a stack on the elevator without damage to the adjacent sheet or sheets. Such apparatus can further comprise means for varying the amplitude and/or frequency of reciprocatory movement of the separating element.

The separating element can be mounted for pivotal movement with reference to the reciprocating means about a substantially horizontal axis which extends transversely of the direction of reciprocatory movement of the separating element and pusher. The apparatus can further comprise means for maintaining the separating element in a state of angular instability or liability but in a substantially horizontal plane. Such labile mounting of the separating element also reduces the likelihood of damage to the adjacent sheet or sheets during penetration of the separating element into a stack on the elevator. The means for maintaining the separating element in a state of angular instability or liability can include a fluid-operated (particularly a pneumatic) damper.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF THE PREFERRED EMBODIMENTS

Figure 1:
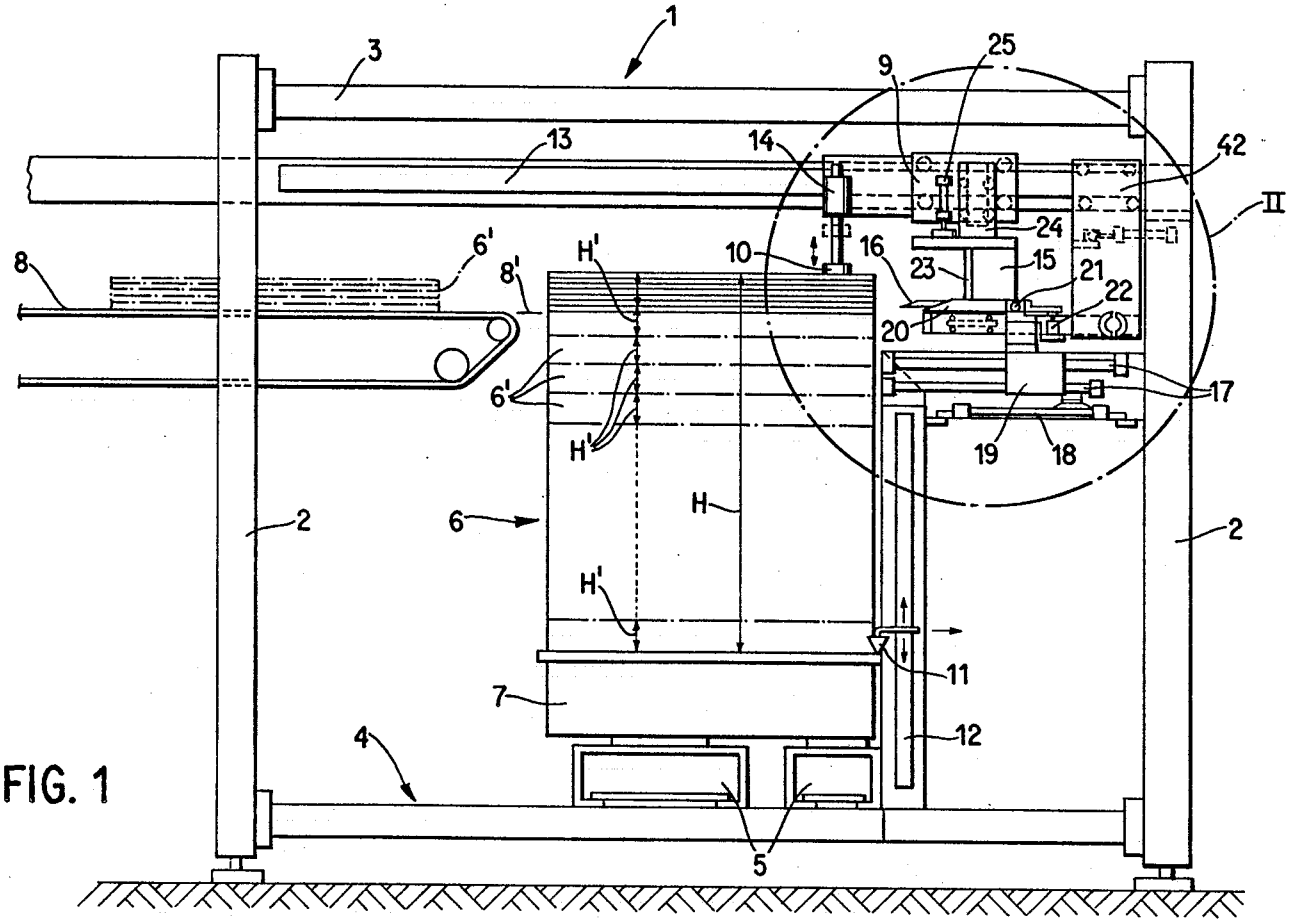
FIG. 1 is a somewhat schematic elevational view of an apparatus which embodies one form of the invention and is shown in the process of measuring the height of a stack on the elevator.

FIG. 1 shows an apparatus which can be used to subdivide a stack 6 of overlapping sheets or panels consisting of paper, cardboard, metallic or plastic foil or the like so that the stack is broken up into a plurality of small stacks or piles 6'. The apparatus comprises a stationary frame 1 with four upright columns 2 and several horizontal or substantially horizontal frame members 3 between the columns. An elevator 4 in the space between the columns 2 is movable up and down to thereby raise the stack 6 or to descend subsequent to removal of the last sheet. The elevator 4 includes a platform 5 for a detachable pallet 7 which actually carries the stack 6. The columns 2 contain vertical feed screws which can be rotated by a single motor or in synchronism by several motors to move the platform 5 and the pallet 7 thereon up or down between any desired number of different levels. The frame members 3 contain horizontal shafts with bevel gears at the ends, and such shafts serve to transmit torque to and/or to synchronize the angular movements of feed screws in the columns 2 in order to ensure that the platform 5 can be moved up or down without tilting or jamming. The exact details of those components of the elevator 4 which serve to move the platform 5 and the pallet 7 thereon up or down along a vertical path in the space between the columns 2 forms no part of the present invention.

The platform 5 can mount one or more endless belt conveyors (not specifically shown) to facilitate the advancement of a loaded pallet 7 to an optimum position for stepwise lifting of the stack 6 thereon or for removal of an empty pallet. The height of the vertical path of movement of the elevator 4 between the columns 2 can match the extent of vertical movability of a loaded pallet 7 in order to break up the stack 6 thereon into a succession of piles 6'.

Figure 2:
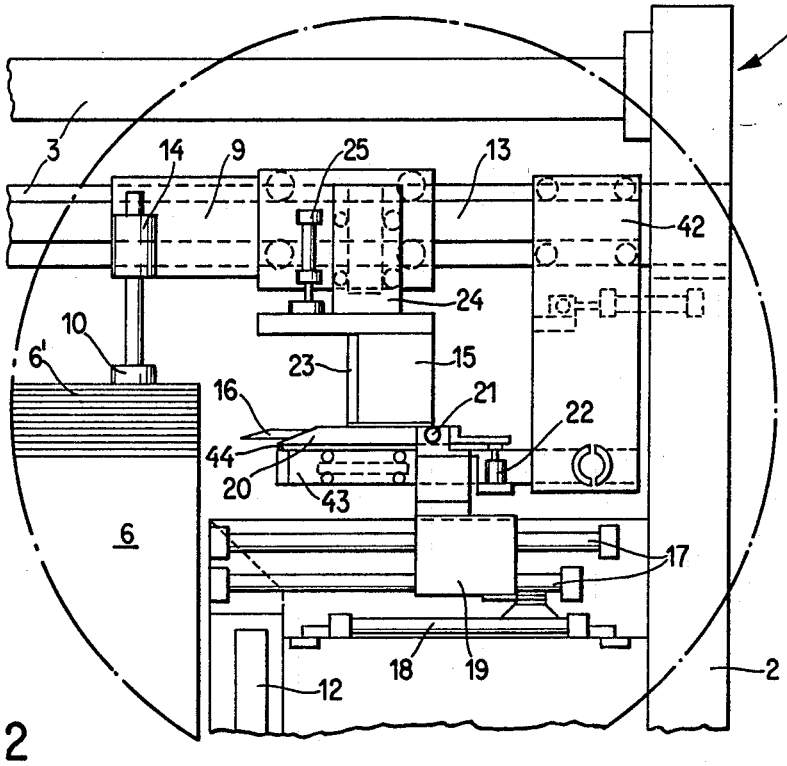
FIG. 2 is an enlarged view of the detail within the phantom-line circle II in FIG. 1.

The apparatus further comprises an endless belt conveyor 8 which is adjacent one side of the vertical path for the pallet 7 on the platform 5 and has an upper reach the horizontal or nearly horizontal upper side or surface 8' is disposed at a predetermined level above the lowermost position of the elevator 4. The conveyor 8 is a so-called telescoped*conveyor which renders it possible to position its receiving (right-hand) end at a desired distance from the vertical path for the stack 6 on the pallet 7 irrespective of the format of the stack. The upper reach of the conveyor 8 serves to deliver successive piles 6' to storage or to a processing machine (e.g., to a wrapping machine for reams of paper sheets). * or pull nose Still further, the apparatus comprises a unit which serves to transfer piles 6' from the top of the stack 6 on the pallet 7 onto the surface 8' of the conveyor 8. The latter can be in continuous motion or is set in motion in response to or shortly prior to reception of a pile 6'. The transferring unit comprises a first carriage or slide 9 which is reciprocable along one or more horizontal guide rails 13 in directions toward and away from the conveyor 8. The carriage 9 supports a stop 10 which is movable by a linear motor 14 up and down by a linear motor 14 between a retracted position (FIG. 3) and an extended position (FIG. 2). The stop 10 forms part of a device which is used to measure the height H of a stack 6 on the pallet 7 of the elevator 4. The measuring device further comprises a vertical scale 12 which is mounted in the frame 1 adjacent the vertical path for the stack 6 and the elevator 4 and is graduated to facilitate visual determination of the height of the stack between the stop 10 (in extended position of the stop) and the upper side of the pallet 7. Still further, the measuring device includes a sensor 11 which is movable up and down along the scale 12 as well as horizontally to and from a position in the path of upward movement of the adjacent marginal portion of the pallet 7. Thus, when the elevator 4 is operated to raise the stack 6 until the topmost sheet of the stack reaches and is arrested by the stop 10 (while the latter dwells in the extended position of FIG. 2), the right-hand marginal portion of the pallet 7 engages and lifts the sensor 11 along the scale 12. When the upward movement of the elevator 4 is interrupted by the stop 10, the distance of the sensor 11 from the stop 10 is indicative of the height H of the stack 6 on the pallet 7. The sensor 11 is located to the right of the pallet 7 when it is caused to assume its retracted or inoperative position so that it cannot be lifted by the pallet 7 or by any other part of the elevator 4.

The height H of a freshly delivered stack 6 is ascertained prior to removal of the first or topmost pile 6'. To this end, the sensor 11 is moved to its operative position (FIG. 1), i.e., into the path of upward movement of a portion of the elevator 4 so that it can be lifted (normally by the pallet 7) as the elevator 4 rises from its lowermost position in order to move the topmost sheet of the stack 6 toward and into engagement with the stop 10. At such time, the motor 14 maintains the stop 10 in the extended position of FIG. 2. The sensor 11 is engaged and lifted by the pallet 7 to move along the scale 12 until the elevator 4 comes to a halt. The sensor 11 can embody or can be combined or otherwise associated with optical, optoelectronic or other suitable signal generating means which generates optical and/or electric signals denoting the exact height H of a fresh stack 6 on the pallet 7. Such signals can be transmitted to a suitable microprocessor or to any other suitable device which calculates the number of piles 6' to be obtained as a result of subdivision of the stack 6 in response to repeated upward movement of the elevator 4 following the transfer of successive piles 6' onto the surface 8' of the conveyor 8. The reference characters H' denote in FIG. 1 the height of discrete piles 6'. The operation of the transferring unit can be regulated by an operator or automatically, depending on the desired or necessary degree of automation of operation of the improved apparatus.

Figure 3:
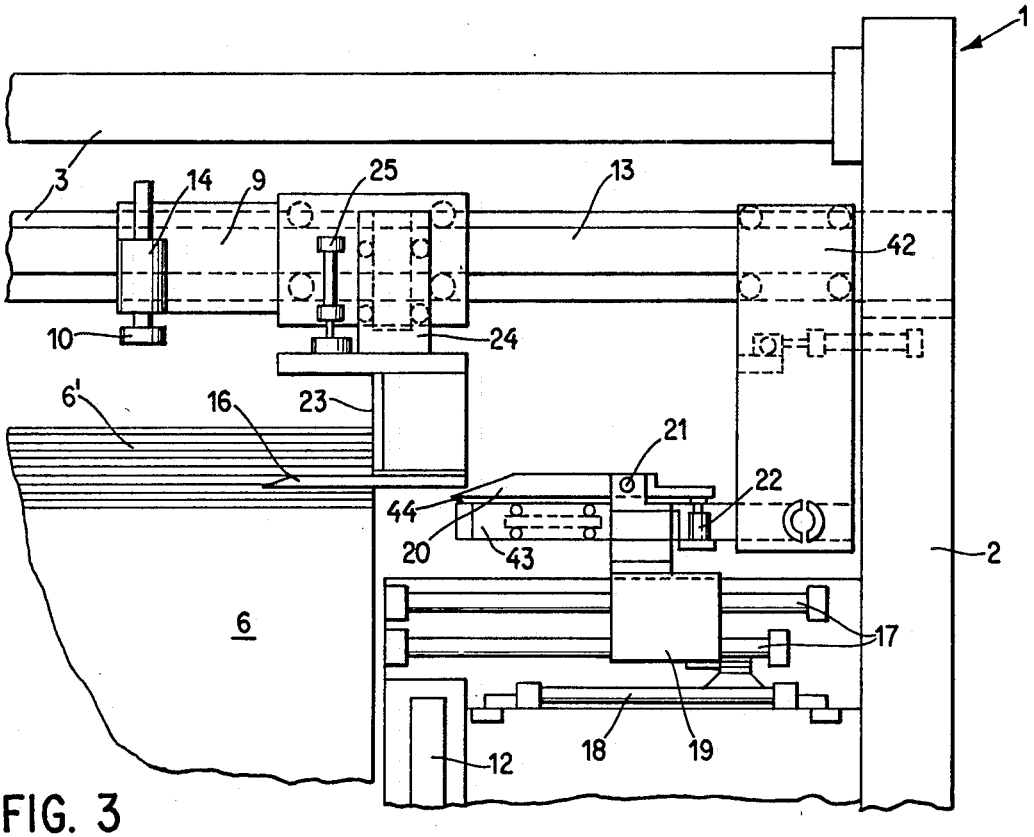
FIG. 3 shows the structure of FIG. 2 but with the separating element in the process of penetrating into a stack on the elevator prior to transfer of the thus formed pile onto the conveyor.

The sensor 11 and the stop 10 are not in use during actual subdivision of the stack 6 into piles 6'; therefore, the motor 14 is caused to raise the stop 10 to the inoperative position of FIG. 3 and the sensor 11 is moved out of the way as soon as the measurement of the height H of a full stack 6 is completed.

The carriage 9 is reciprocable by a reversible electric or other suitable motor (not shown), e.g., by a motor which can drive a pinion mating with a straight rack on the guide rail 13 in order to move the carriage back and forth in directions toward and away from the conveyor 8. This carriage supports a downwardly extending pusher 15 and a separating element 16 at a level beneath the pusher. The substantially flat and substantially horizontal separating element 16 is located at or slightly above the level of the surface 8', i.e., the pusher 15 is invariably located above such level. The front side or surface 23 of the pusher 15 engages and shifts a pile 6' from the vertical path for the stack 6 on the pallet 7 toward and onto the surface 8' when the carriage 9 causes the pusher 15 and the separating element 16 to perform a stroke from the first or retracted position of FIG. 1 or 2 to a second position (not shown) in which the separating element has penetrated into the stack 6 and the front side 23 has completed the transfer of a pile 6' of sheets above the separating element onto the surface 8' of the conveyor 8. An intermediate position of the pusher 15 and separating element 16 is shown in FIG. 3; the separating element 16 has already penetrated into the stack 6 and the front side 23 abuts the adjacent side of the pile 6' above the separating element preparatory to transfer of the pile 6' onto the upper reach of the conveyor 8.

The frame 1 carries two horizontal rods 17 at a level beneath the carriage 9. The rods 17 serve as a guide means for a second horizontally reciprocable carriage or slide 19. The means for moving the slide 19 toward and away from the conveyor 8 comprises a fluid-operated motor 18, an endless belt or chain conveyor or any other suitable means for causing two hold-down devices 20 to penetrate into the gap which is formed by the separating element 16 between a pile 6' and the remnant of the stack 6 beneath such pile. The hold-down devices 20 flank the separating element 16 and serve to hold the topmost sheet of the remnant of the stack 6 on the pallet 7 from sharing the movement of the lowermost sheet of a pile 6' onto the upper reach of the conveyor 8.

The front portions or arms of the hold-down devices 20 resemble wedges which taper in a direction toward the conveyor 8 in order to facilitate penetration of the hold-down devices into the aforementioned gap between a pile 6' and the remnant of the stack 6 below such pile. The slide 19 supports a horizontal pivot member 21 which extends at right angles to the direction of reciprocatory movement of the pusher 15 and separating element 16 and serves as a fulcrum for the hold-down devices 20. The means for pivoting the hold-down devices 20 about the axis of the pivot member 21 includes a cylinder and piston unit 22. The arrangement is preferably such that the hold-down devices 20 are pivoted clockwise to the solid-line positions of FIG. 4 preparatory to and during penetration into the gap in the stack 6 and are thereupon pivoted counterclockwise to the phantom-line positions of FIG. 4 in order to bear upon the topmost sheet of the remnant of the stack 6 on the pallet 7 and to thus hold such sheet against movement toward the conveyor 8 while the front side 23 of the pusher 15 is in the process of shifting a pile 6' onto the upper reach of the conveyor.

Figure 4:
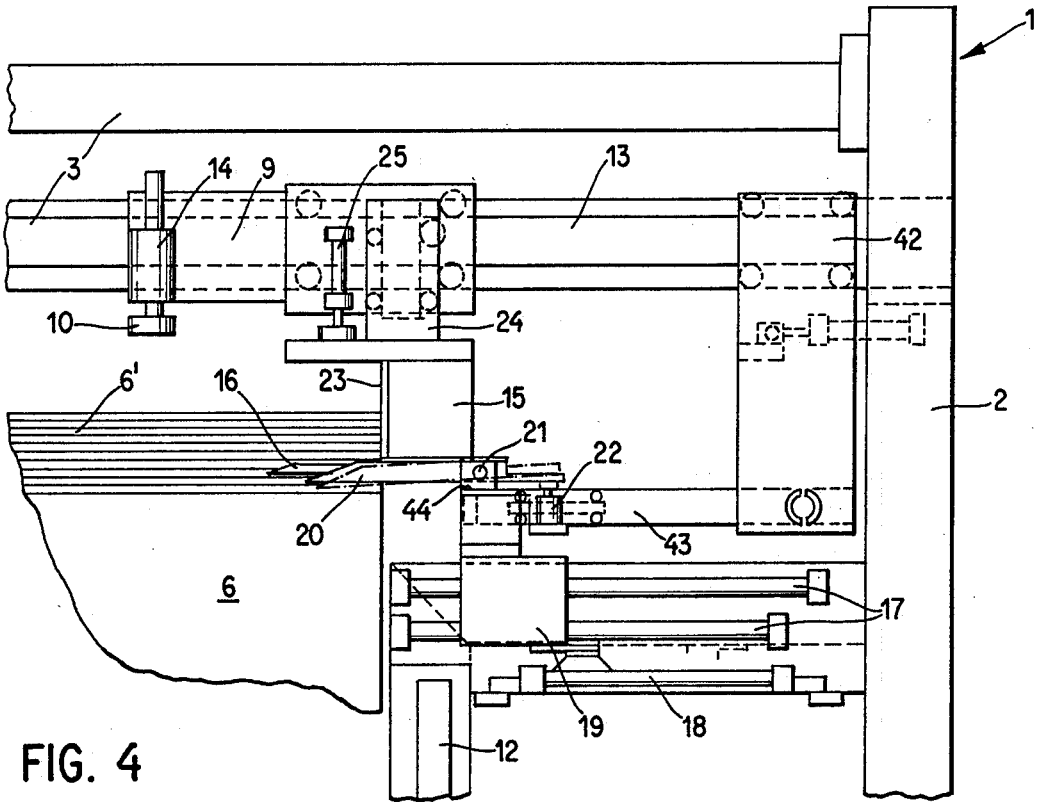
FIG. 4 shows the structure of FIG. 3 but with the hold-down devices moved forwardly so that their wedge-like arms extend into the gap which is formed by the separating element between two sheets of the stack on the elevator.

In order to transfer a pile 6' from the vertical path for the stack 6 on the pallet 7 onto the upper reach of the conveyor 8, the elevator 4 is caused to move upwardly through a distance H' corresponding to the selected or calculated height of a pile 6'. The elevator 4 comes to a halt when the height of the stack portion (future pile 6') above the level of the separating element 16 equals H'. The next step involves a movement of the carriage 9 in a direction toward the conveyor 8 so that the tip 36 (see FIGS. 8–10) of the separating element penetrates between two neighboring sheets of the stack 6. The separating element 16 thus establishes a gap which is sufficiently wide to permit convenient insertion of wedge-shaped front arms of the hold-down devices 20 which are moved by the slide 19, i.e., by the moving means 18 so that they advance from the retracted positions of FIGS. 1–3 to the extended positions of FIG. 4. At such time, the cylinder and piston unit 22 maintains the hold-down devices 20 in those angular positions which are shown in FIG. 4 by solid lines. Once the penetration of wedge-shaped front arms of the hold-down devices 20 into the gap of the stack 6 is completed, the cylinder and piston unit 22 pivots the hold-down devices in a counterclockwise direction to the phantom-line positions of FIG. 4 so that the front end portions of the hold-down devices are capable of holding the topmost sheet of the remnant of the stack 6 against movement with the pusher 15 in a direction toward the conveyor 8.

The carriage 9 comes to a temporary halt when the pusher 15 reaches the position of FIG. 3 in order to enable the hold-down devices 20 to enter the aforediscussed gap in the stack 6 before the carriage 9 is set in motion again in order to transfer the pile 6' onto the upper reach of the conveyor 8. The speed of movement of the pusher 15 and separating element 9 from the intermediate position of FIGS. 3 and 4 to the second position (in which the front side 23 of the pusher 15 is or can be immediately or closely adjacent the receiving end of the conveyor 8) preferably takes place at the speed of movement of the upper reach of the conveyor. The surface 8' is preferably roughened or coated with a layer of friction generating material in order to ensure predictable entrainment of the lowermost sheet of a pile 6' which is being transferred from the elevator 4 onto the conveyor 8. The separating element 9 slides along the sheet which is engaged by the hold-down devices 20 and contributes to predictable transfer of the pile 6' because the exposed surfaces of the element 9 are preferably polished or treated in a similar way to reduce friction between such surfaces and the adjacent sheet or sheets of the stack 6. In addition, the separating element 16 is preferably provided with one or more channels 38 and ports 40 (FIGS. 8 to 10) for streamlets of compressed air or another suitable gaseous fluid. The streamlets penetrate into the gap between a pile 6' and the remnant of the stack 6 in order to further reduce friction between the lowermost sheet of the pile and the stack. The streamlets of pressurized fluid establish a cushion which causes at least a portion of the lowermost sheet of the pile 6' to float on the adjacent topmost sheet of the remaining part of the stack 6. It has been found that such design of the separating element 9 contributes to highly predictable transfer of successive piles 6' onto the conveyor 6 without damage to the sheets and at a high speed such as is desirable and necessary in many production lines wherein piles of sheets are processed at a high frequency.

As mentioned above, the surface 8' is capable of frictionally engaging and entraining the lowermost sheets of successive piles 6' to ensure predictable transport of such piles to storage or to a processing (e.g., wrapping) machine.

The pusher 15 is movable up and down along one or more vertical guides 24 of the carriage 9. A preferably pneumatic damper 25 or an equivalent device yieldably biases the pusher 15 to its lower end position with reference to the carriage 9. Such vertical movability of the pusher 15 and of the element 16 is desirable and advantageous in order to reduce the likelihood of damage to sheets during penetration of the element 9 into a stack 6 on the elevator 4 as well as for other reasons.

Figure 5:
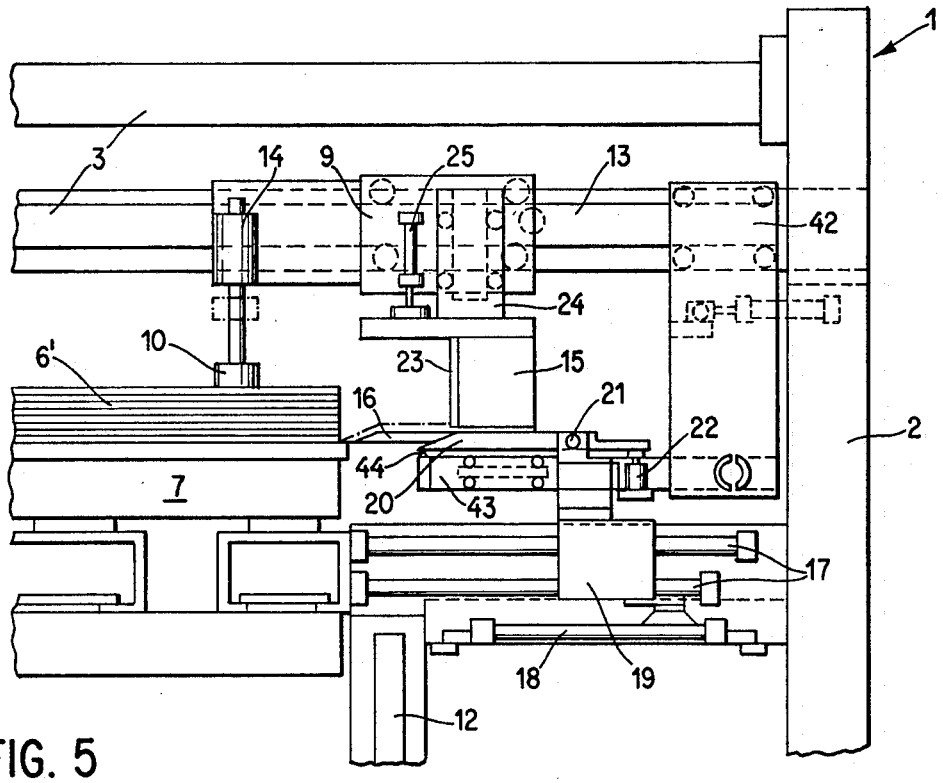
FIG. 5 shows the structure of FIG. 2 with the separating element about to penetrate between the lowermost sheet of the remnant of a stack and the pallet of the elevator.

FIG. 5 shows the parts of the improved apparatus in positions they assume when the pusher 15 and the associated separating element 16 are about to transfer the last or lowermost pile 6' of a stack 6 from the pallet 7 onto the conveyor 8. The linear motor 14 has moved the stop 10 to its extended or lower end position and the topmost sheet of the pile 6' (remnant of stack 6) on the pallet 7 abuts the stop. The carriage 9 has moved the separating element 16 to a position in which the tip 36 of the separating element overlies the adjacent unoccupied marginal portion of the pallet 7. This has taken place prior to lifting of the pile 6' to the level of FIG. 5 in which the topmost sheet of the pile abuts the stop 10. Therefore, the ascending right-hand marginal portion of the pallet 7 can slightly lift the separating element 16 and the pusher 15 against the opposition of the biasing means or damper 25 to thus ensure that the underside of the separating element is in actual contact with and is ready to slide along the upper side of the pallet 7. The motor 14 thereupon retracts the stop 10 to the position of FIG. 4 and the carriage 9 is started to move the pusher 15 and the separating element 16 toward the conveyor 8 (not shown in FIG. 5) for transfer of the last pile 6' onto the upper reach of the conveyor. The distance through which the marginal portion of the pallet 7 is to lift the separating element 9 and the pusher 15 against the opposition of the damper or biasing means 25 is very small, e.g., in the range of one or more millimeters. The damper or biasing means 25 stores energy as a result of upward movement of the separating element 16 and pusher 15 with reference to the carriage 9; this ensures that the tip 36 of the separating element penetrates between the lowermost sheet of the last pile 6' and the pallet 7 when the carriage 9 is thereupon set in motion in order to enable the separating element to penetrate beneath the pile 6' and to enable the pusher 15 to transfer the pile onto the conveyor 8.

The elevator 4 thereupon descends to its lower end position, the empty pallet 7 is replaced with a pallet which carries a full stack 6, and the aforedescribed sequence of steps is repeated in order to measure the height of the full stack and to thereafter break up the stack into a series of piles 6' which are transferred onto the upper reach of the conveyor 8. If the dimensions of sheets in the fresh stack depart from the dimensions of sheets in the preceding stack, the conveyor 8 is caused to move its upper reach to an optimum position for reception of piles 6' forming successively separated portions of the fresh stack.

In order to ensure that the tip 36 of the separating element 16 will invariably move into the path of upward movement of a pallet 7 which carries the last or lowermost pile 6' of a stack (i.e., to ensure that the carriage 9 will maintain the separating element 16 in the position of FIG. 5), the apparatus can further comprise a monitoring device 43 which is mounted on a further carriage or slide 42. The right-hand side of the last pile 6' on a pallet 7 following removal of the next-to-the-last pile 6'. The slide 42 is reciprocable along the rail or rails 13 for the carriage 9. The monitoring device 43 includes a photoelectronic detector 44. The latter includes a radiation source and a transducer. The beam of radiation issuing from such source is adjacent the right-hand side of the last pile 6' on a pallet 7, and such beam is interrupted by the tip 36 of the separating element 16 when the later reaches the position of FIG. 5. The transducer of the detector 44 then transmits a signal to the motor for the carriage 9 in order to ensure that the separating element 16 comes to a halt while its tip 36 is located in the path of upward movement of the right-hand marginal portion of the pallet 7. Therefore, the pallet 7 is in a position to lift the separating element 16 and the pusher 15 against the opposition of the biasing means or damper 25 which, in turn, ensures that the lowermost sheet of the last pile 6' is transferred with other sheets of such pule while the carriage 9 advances the pusher 15 and the separating element 16 to the left, i.e., beyond the intermediate position of FIG. 5. The slide 42 retracts the monitoring device 43 and its optoelectronic detector 44 before the elevator 4 is set in motion to lift the separating element 16 and the pusher 15 against the opposition of the biasing means 25.

Figure 6:
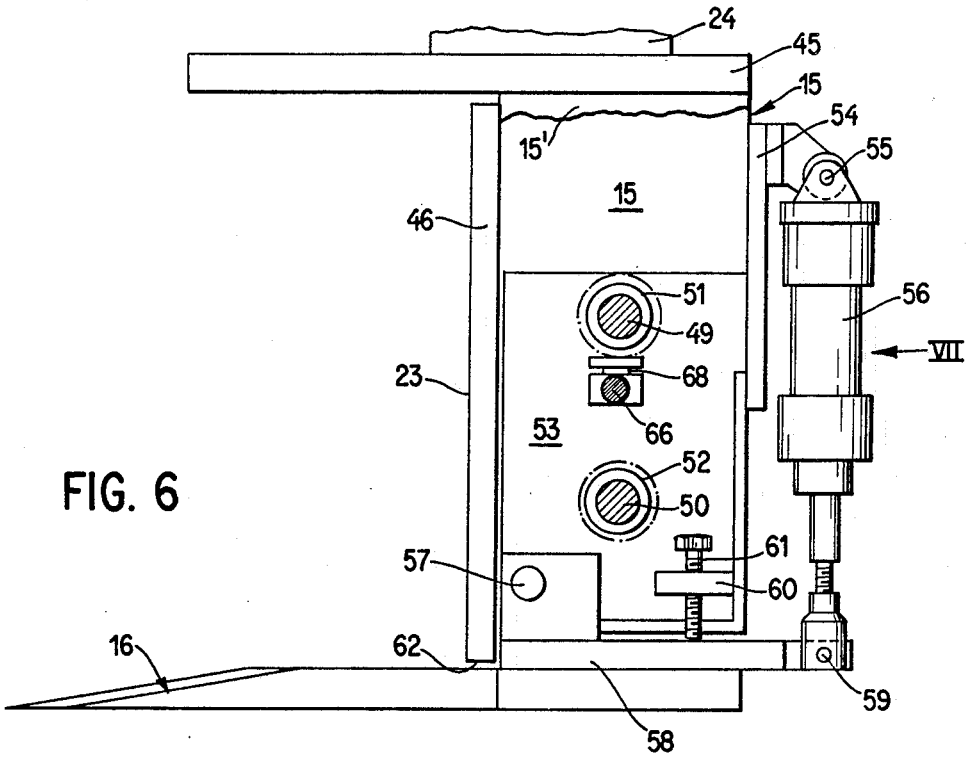
FIG. 6 is a fragmentary elevational view of an apparatus wherein the separating element is mounted for pivotal movement about a substantially horizontal axis and is maintained in a state of angular lability in a substantially horizontal plane.
Figure 7:
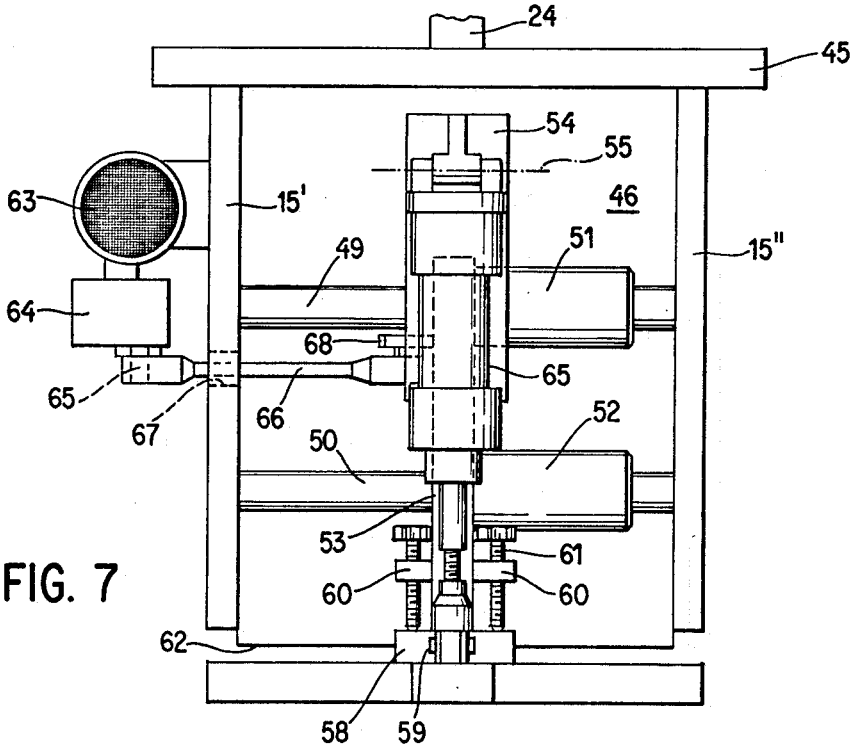
FIG. 7 is a view as seen in the direction of arrow VII in FIG. 6 and further shows a unit which serves to oscillate the separating element during penetration into or beneath a stack on the elevator.

If the stack 6 on the elevator 4 consists of highly sensitive sheets, the transferring unit is preferably constructed and assembled in a manner as shown in FIGS. 6 and 7. The pusher 15 of this transferring unit comprises two spaced apart parallel vertical plates 15' and 15". The upper end portions of the plates 15' and 15" are connected to each other by a horizontal plate 45 which is affixed to the vertical guide 24 of the carriage 9. In addition, the pusher 15 of FIGS. 6 and 7 comprises a front plate 46 which defines the front side 23 and also serves to connect the vertical plates 15', 15" to each other.

The plates 15', 15" are fixedly connected with the respective end portions of two parallel horizontal guide rods 49, 50 for bearing sleeves 51, 52, respectively. The bearing sleeves 51, 52 are reciprocable along the respective guide rods 49, 50 and are rigidly connected with a plate-like carrier 53 which supports a further plate-like carrier 54 for a pivot member 55 at the upper end of a fluid-operated (preferably pneumatic) damper 56. The lower end portion of the damper 56 carries a pivot member 59 which is articulately connected to the rear end portion of the separating element 16. The latter is a two-armed lever which is pivotable on the pusher 15 about the substantially horizontal axis of a shaft 57 extending at right angles to the direction of reciprocatory movement of the pusher 15 and separating element 16 toward and way from the conveyor 8 (not shown in FIGS. 6 and 7). The reference character 58 denotes a bell crank lever which forms part of the separating element 16 and is fulcrumed (at 57) on the pusher 15 as well as articulately connected (at 59) to the lower end portion of the damper 56. The latter serves as a means for maintaining the separating element 16 in a state of angular instability or lability in a substantially horizontal plane. Thus, the separating element 16 has limited freedom of angular movement about the axis of the shaft 57 in a clockwise as well as in a counterclockwise direction. The extent of pivotability of the separating element 16 in a counterclockwise direction (as seen in FIG. 6) is limited by the tips of screws 61 which extend through and downwardly beyond tapped bores or holes in lugs 60 forming part of the pusher 15. If the bell crank lever 58 is a separately produced part, it is fixedly (separably or permanently) connected to the remaining portion of the separating element 16 by screws, by rivets or in any other suitable way. The underside 62 of the plate 46 serves as a means for limiting the extent of pivotability of the separating element 16 in a clockwise direction. The extent of pivotability of the separating element 16 can be regulated by the screws 61.

If the tip 36 of the separating element 16 of FIG. 6 is acted upon by an upwardly or downwardly directed force, the separating element is free to pivot about the axis of the shaft 57 in a clockwise or counterclockwise direction against the resistance of the damper 56 so that the tip 36 of the separating element can readily find its way between two neighboring sheets of a stack on the elevator 4 (not shown in FIGS. 6 and 7). The extent of such pivotability of the separating element 16 is limited by the screws 61 and by the underside 62 of the plate 46. Such pivotability of the separating element 16 greatly reduces the likelihood of damage to the sheets of a stack 6 which is about to be subdivided into piles and/or the likelihood of damage to the lowermost sheet of the last pile on the elevator. The damper 56 will become effective whenever the tip of the separating element 16 happens to engage the adjacent edge of a sheet rather than penetrating between two neighboring sheets or penetrating between the lowermost sheet of the last pile and a pallet 7 on the elevator 4. The tip 36 of the separating element 16 then tends to yield by pivoting in a clockwise or counterclockwise direction in order to find a way for penetration of its tip 36 between two sheets or between the lowermost sheet of a pile and a pallet 7.

The damper 56 can be used in lieu of or in combination with additional means for facilitating or promoting penetration of the tip 36 of the separating element 16 between two neighboring sheets or beneath the lowermost sheet of the last pile. FIG. 7 shows that the apparatus can further comprise means for vibrating the separating element 16 substantially transversely of the direction of movement of the pusher 15 and separating element toward or away from the conveyor for piles 6'. The plate 15' of the pusher 15 carries a variable-speed electric motor 63 which orbits an eccentric pin or stud 65 through the medium of a suitable transmission 64. The stud 65 is coupled to one end of a connecting rod 66 which extends through a window 67 of the plate 15' and is connected with the carrier 53 on the bearing sleeves 51, 52 by means of a pin 68. When the motor 63 is on, the carrier 53 reciprocates along the guide rods 49, 50 and the damper 56 as well as the separating element 16 share such movements of the carrier 53. The frequency of vibratory movements of the separating element 16 along the guide rods 49, 50 can be regulated by the variable-speed motor 63, and the amplitude of such vibratory movement can be regulated by changing the stroke of the connecting rod 66 or in any other suitable way. For example, the pin 65 can be adjustably mounted on its crank arm or disc so that it can select the stroke of the connecting rod 66 and hence the amplitude of vibratory movement of the separating element 16 in directions at right angles to the direction of transfer of piles 6' onto the conveyor 8. Such vibratory movements of the separating element 16, especially in combination with unstable angular positioning of the separating element within the limits imposed by the screws 61 and the underside 62 of the plate 46, even further reduce the likelihood of damage to the adjacent sheet or sheets of a stack during penetration of the tip 36 of the separating element into or beneath a stack on the elevator.

The motor 63 can be operated continuously or intermittently, i.e., at least when the tip 36 of the separating element 16 has been moved into immediate proximity of sheets on the pallet 7 or has actually contacted one or more sheets. Vibratory movements of the separating element 16 when the motor 63 is on even further enhance the likelihood that the tip 36 of the separating element will move up or down (against the opposition of the damper 56) if and when the tip 36 happens to strike the edge of a sheet instead of entering the stack or the space between the stack and the pallet.

Figure 10:
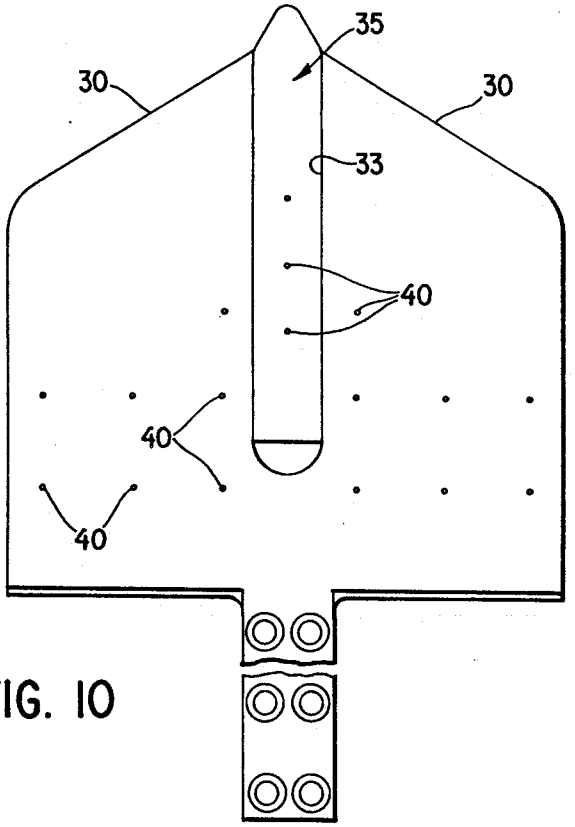
FIG. 10 is a bottom plan view of the separating element of FIG. 8.
Figure 8:
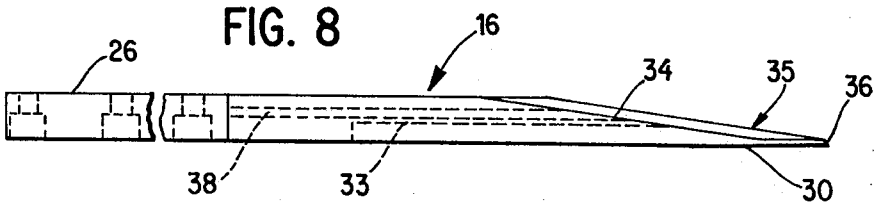
FIG. 8 is an enlarged side elevational view of a presently preferred embodiment of the separating element.
Figure 9:
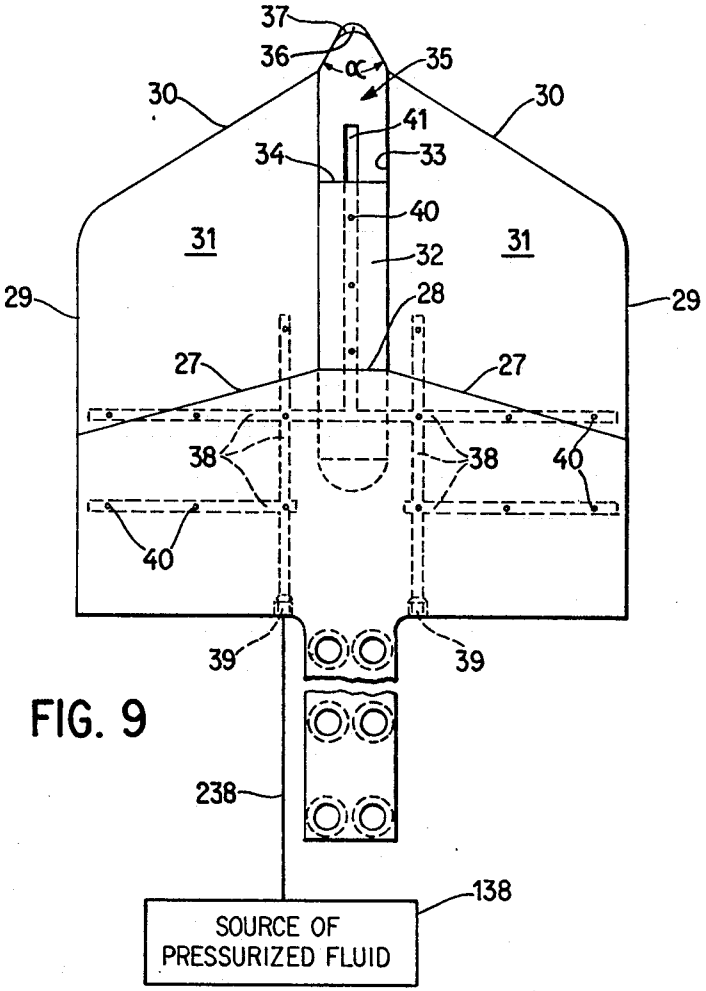
FIG. 9 is a top plan view of the separating element of FIG. 8.

FIGS. 8 to 10 show the details of a presently preferred separating element 16. The latter resembles the blade of a shovel and its tip 36 is rounded so that its convex front edge face confronts the conveyor 8. The rearward extension of the separating element 16 is fixedly (FIGS. 1–5) or pivotally (FIGS. 6–7) connected to the pusher 15. The separating element 16 of FIGS. 8 to 10 constitutes the entire separating element if the latter is fixedly connected to the pusher 15 (in a manner as shown in FIGS. 1 to 5), or that portion of a composite separating element which is connected to the bell crank lever 58 of FIG. 6.

The underside of the separating element 16 of FIGS. 8 to 10 is substantially flat. The upper side of this separating element includes a rear portion 26 which is parallel to the flat underside and terminates at edges 27, 28, 27 behind a relatively wide (second) portion 31. The upper side of the portion 31 slopes forwardly (toward the tip 36) as well as laterally toward the lateral edge faces 29 of the separating element 16. The median portion 32 of the upper side of portion 31 extends to a transverse edge 34 behind the tip 36. As can be seen in FIG. 10, the portion 31 resembles a wedge which tapers forwardly toward the tip 36 as well as laterally toward the lateral edge faces 29. The front edge faces 30 of the portion 31 taper toward the tip 36 and have radii of curvature of less than 0.5 millimeter, preferably between 0.15 and 0.45 millimeter and most preferably approximately 0.3 millimeter. At least those surfaces of the separating element 16 which come in contact with the sheets of stacks and/or with the upper side of a pallet are polished to a high or very high degree of finish to even further enhance the likelihood of immediate penetration between a pair of neighboring sheets or between the lowermost sheet of the last pile 6' and the pallet 7.

The underside of the separating element 16 is provided with a centrally located forwardly extending groove 33 having a rectangular crosssectional outline. This groove terminates at the aformentioned transversely extending edge 34 where it becomes a slot extending all the way between the upper side and the underside of the separating element 16. The groove 33 receives a strip-shaped insert or sword 35 which constitues a front portion of the element 16 and includes the aforementioned tip 36. The underside of the sword 35 is substantially coplanar with the underside of the portion 31, and this sword extends forwardly beyond the rounded front edge faces 30 of the portion 31. As can be seen in FIG. 10, the sword 35 tapers forwardly toward its tip 36, and its front edge faces converge toward the tip 36 in the general plane of the separating element 16. The angle alpha between the front edge faces of the sword 35 is between 30 and 60°, preferably between 45 and 55°. The inclination of the upper side of the sword 35 with reference to the underside is not more than 15°, preferably between 5 and 10°. The upper side of the sword 35 tapers toward the underside in a direction toward the tip 36 up to an arcuate line 37 slightly behind the rounded front edge face of the tip. The thickness of the tip 36 between the line 37 and the rounded front edge face is preferably constant. The width of the sword 35 is not more than 61 millimeters, preferably not more than 50 millimeters and most preferably approximately 35 millimeters. The thickness of the tip 36 is less than 1 millimeter, preferably between 0.2 and 0.8 millimeter and most preferably approximately 0.35 millimeter. The exposed surfaces of the sword 35 and its tip 37 are polished. The angle alpha is smaller than the angle between the front edge faces 30 of the portion 31; the angle between the front edge faces 30 is between 60 and 150°, preferably approximately 120°.

The sword 35 is fixed to the major part of the separating element 16, e.g., by an adhesive or by mechanical means. The separating element 16 is formed with the aforementioned internal channels 38 having inlets 39 connected to a source 138 of pressurized gaseous fluid (such as air) by flexible hoses 238 (one shown) or in another suitable way. This renders it possible to fixedly mount the source 138 in or on the frame 1 so that the source need not share the movements of the carriage 9 relative to the guide rail 13 and/or the up and down and/or vibratory and/or pivotal movements of the separating element 16 with reference to the carriage 9 and/or pusher 15. The channels 38 can discharge streamlets of pressurized gaseous fluid by way of the respective ports 40 which ensure that a gaseous cushion is formed in the gap between two sheets of a stack 6 or between the lowermost sheet of a stack and the pallet 7. The sword 35 has a groove-like channel 41 which is optional and communicates with at least one of the channels 38 to deliver pressurized fluid to the upper side of the sword immediately or closely behind the tip 36. The channel 41 is disposed along the upper side of the sword 35 forwardly of the edge 34 where the groove 33 becomes a slot.

It goes without saying that the apparatus further comprises suitable valve means to regulate the admission of pressurized fluid into the channels 38 and to seal the channels 38 from the source 138 when the apparatus is not in use or when the separating element 16 is not in the process of penetrating, or is not yet about to penetrate, between two sheets of a stack 6 or between the lowermost sheet of a stack and the respective pallet 7.

An advantage of the aforedescribed apparatus is that it can automatically subdivide stacks 6 into piles 6' of desired height and that the need for manual labor is eliminated or is reduced to a minimum. The exact nature of the means for programming the operation of the apparatus (such means can include one or more microprocessors and/or other parts which are normally employed in the controls of automatic machine tools and/or other machines) forms no part of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for subdividing stacks of overlapping discrete sheets of paper and the like into piles, comprising a stack-supporting elevator movable up and down along a substantially vertical path; and a conveyor adjacent one side of said path and having a substantially horizontal surface disposed at a predetermined level and arranged to receive piles from the stack on said elevator, said elevator being movable to positions in which a portion at least of the stack of sheets thereon extends above said level; and means for transferring piles of sheets from the top of the stack on said elevator onto said surface, including a pusher above said level, a substantially horizontal and substantially flat separating element disposed beneath said pusher at or above said level and extending beyond said pusher toward said conveyors and means for reciprocating said pusher and said element along a substantially horizontal path between a retracted position in which said pusher and said element are located at a first distance from said conveyor at the other side of said vertical path, and a second position in which said pusher and said element are located at a shorter second distance from said conveyor whereby said element penetrates into the stack on said elevator to separate a pile of sheets located above said element from sheets therebelow and the pusher thereupon transfers the thus formed pile element from said vertical path onto said surface during movement of said pusher and said element from said first to said second position.

2. The apparatus of claim 1, wherein said elevator comprises a platform and a pallet for stacks on said platform.

3. The apparatus of claim 1, wherein said surface of said conveyor is closely adjacent said one side of said vertical path.

4. The apparatus of claim 1, wherein said separating element includes a tip which is nearest said, conveyor and has a thickness which is less than one millimeter.

5. The apparatus of claim 4, wherein said thickness is less than 0.9 millimeter.

6. The apparatus of claim 4, wherein said thickness is approximately 0.5 millimeter.

7. The apparatus of claim 4, wherein the thickness of said tip is substantially constant.

8. The apparatus of claim 4, wherein said tip has a rounded edge confronting said conveyor.

9. The apparatus of claim 4, wherein the width of at least a portion of said substantially horizontal and substantially flat separating element increases in a direction away from said conveyor.

10. The apparatus of claim 9, wherein said separating element includes two mirror symmetrical halves.

11. The apparatus of claim 4, wherein said separating element further includes a front portion which is immediately adjacent and/or includes said tip and has a width of less than 61 millimeters, said tip having a round outline in the plane of said substantially flat and substantially horizontal separating element.

12. The apparatus of claim 11, wherein said front portion of said element has a substantially wedge-shaped outline in said plane and tapers toward said tip.

13. The apparatus of claim 4, wherein the thickness of a portion at least of said separating element increases gradually starting at said tip in a direction away from said conveyor.

14. The apparatus of claim 4, wherein the thickness of said tip increases gradually in a direction away from said conveyor.

15. The apparatus of claim 4, wherein said separating element has a front portion adjacent said tip and having a width of less than 61 millimeters, and a second portion having rounded front edge faces and a width greater than the width of said front portion, said edge faces sloping toward said tip at opposite sides of said front portion.

16. The apparatus of claim 15, wherein said front edge faces have radii of curvature in the range of up to 0.6 millimeter, preferably approximately 0.2–0.35 millimeter.

17. The apparatus of claim 4, wherein said separating element has an external surface and at least a portion of said external surface is polished.

18. The apparatus of claim 4, wherein said separating element has at least one channel and an external surface with at least one port in communication with said at least one channel, and further comprising a source of pressurized fluid connected to said channel, at least while said separating element is away from said first position, so that said at least one port admits pressurized fluid into the stack at the locus of penetration of said element.

19. The apparatus of claim 4, wherein said conveyor includes an endless belt comprising an upper reach having a friction generating upper side constituting said substantially horizontal surface.

20. The apparatus of claim 4, wherein said pusher and said separating element are movable up and down with reference to said reciprocating means, said transferring means further comprising means for biasing said pusher and said separating element downwardly.

21. The apparatus of claim 20, wherein said elevator includes a portion which extends beyond the stack thereon in a direction away from said conveyor and the tip of said separating element is movable into the path of upward movement of said portion of said elevator so that such portion of the elevator can lift said separating element against the opposition of said biasing means.

22. The apparatus of claim 21, wherein said transferring means includes means for limiting the upward movement of said separating element to one or more millimeters preparatory to movement of said element and said pusher to said second position.

23. The apparatus of claim 4, further comprising hold-down devices flanking said separating element and means for moving said devices into and from said vertical path to enter the gap which is established by said separating element as a result of penetration into the stack on said elevator.

24. The apparatus of claim 23, further comprising means defining for said hold-down devices substantially horizontal pivot axes extending substantially transversely of the direction of reciprocatory movement of said separating element.

25. The apparatus of claim 24, wherein each of said hold-down devices includes a front arm which penetrates into said gap and is tiltable downwardly about the respective pivot axis to bear against the topmost sheet in the stack beneath the gap.

26. The apparatus of claim 23, wherein said hold-down devices include substantially wedgelike front portions confronting and tapering toward said conveyor.

27. The apparatus of claim 4, further comprising means for measuring the height of a stack on said elevator, including a stop disposed above said vertical path and arranged to arrest the ascending topmost sheet of a stack on said elevator and to thus hold the elevator against further upward movement, an upright scale adjacent said vertical path to indicate the height of a stack between the topmost sheet which is arrested by said stop and the lowermost sheet, and a sensor movable. along said scale into and from engagement with the elevator in the region of the lowermost sheet a stack on said elevator.

28. The apparatus of claim 27, further comprising means for generating signals denoting the distance of said stop from said sensor.

29. The apparatus of claim 28, wherein said stop is movable with reference to said elevator to and from an operative position in said vertical path.

30. The apparatus of claim 4, wherein at least a portion of said conveyor is movable with reference to said elevator to place said horizontal surface at a selected distance from said one side of said vertical path.

31. The apparatus of claim 4, further comprising means for vibrating said separating element at least during penetration of said tip into the stack on said elevator.

32. The apparatus of claim 31, wherein said vibrating means includes means for moving said separating element substantially horizontally back and forth transversely of the direction of movement of said element between said first and second positions.

33. The apparatus of claim 31, further comprising means for varying the amplitude and/or frequency of vibratory movement of said separating element.

34. The apparatus of claim 4, wherein said separating element is pivotable with reference to said reciprocating means about a substantially horizontal axis extending transversely of the direction of reciprocatory movement of said element between said first and second positions, and further comprising means for maintaining said element in a state of angular lability in a substantially horizontal plane.

35. The apparatus of claim 34, wherein said maintaining means includes a fluid-operated damper.

* * * * *